US010337140B2

(12) United States Patent
Hartert et al.

(10) Patent No.: US 10,337,140 B2
(45) Date of Patent: Jul. 2, 2019

(54) METHOD OF MANUFACTURING A PENETRATION-RESISTANT ARTICLE THAT INCLUDES A TEXTILE FABRIC MADE FROM ARAMID FIBERS

(71) Applicant: TEIJIN ARAMID GMBH, Wuppertal (DE)

(72) Inventors: Rudiger Hartert, Wuppertal (DE); Peter Gerard Akker, Doetinchem (NL)

(73) Assignee: TEIJIN ARAMID GMBH, Wuppertal (DE)

( * ) Notice: Subject to any disclaimer, the term of this patent is extended or adjusted under 35 U.S.C. 154(b) by 68 days.

(21) Appl. No.: 15/790,553

(22) Filed: Oct. 23, 2017

(65) Prior Publication Data

US 2018/0044848 A1 Feb. 15, 2018

Related U.S. Application Data

(63) Continuation of application No. 13/394,233, filed as application No. PCT/EP2010/062522 on Aug. 27, 2010, now Pat. No. 9,834,883.

(30) Foreign Application Priority Data

Sep. 3, 2009 (EP) ..... 09169383

(51) Int. Cl.
*D06M 15/513* (2006.01)
*D06M 101/36* (2006.01)

(52) U.S. Cl.
CPC ..... *D06M 15/513* (2013.01); *D06M 2101/36* (2013.01); *Y10T 442/2861* (2015.04)

(58) Field of Classification Search
CPC .. D06M 7/00; D06M 13/292; D06M 2200/40; D06M 15/513; D06M 2101/36; H05K 999/99
USPC ..... 2/463; 442/164
See application file for complete search history.

(56) References Cited

U.S. PATENT DOCUMENTS

| | | | |
|---|---|---|---|
| 4,652,488 | A | 3/1987 | Willemsen et al. |
| 5,545,481 | A | 8/1996 | Harrington |
| 5,569,408 | A | 10/1996 | Peppmoller et al. |
| 6,890,871 | B2 | 5/2005 | Bottger et al. |
| 2004/0142617 | A1 | 7/2004 | Bottger et al. |
| 2006/0105168 | A1 | 5/2006 | Willemsen et al. |
| 2008/0085411 | A1 | 4/2008 | Prickett |

FOREIGN PATENT DOCUMENTS

| | | | |
|---|---|---|---|
| EP | 0511589 | A1 | 11/1992 |
| WO | 02/075238 | A1 | 9/2002 |
| WO | 2008/148550 | A1 | 12/2008 |

OTHER PUBLICATIONS

Mar. 16, 2016 Office Action issued in U.S. Appl. No. 13/394,233.
Jul. 20, 2016 Office Action issued in U.S Appl. No. 13/394,233.
Oct. 4, 2010 International Search Report issued in International Patent Application No. PCT/EP2010/062522.
"Estesol," Trademark Electronic Search System (date of search: Feb. 19, 2014).
Mar. 2, 2017 Office Action issued in U.S. Appl. No. 13/394,233.
Aug. 26, 2015 Office Action issued in U.S. Appl. No. 13/394,233.
Mar. 12, 2015 Office Action issued in U.S. Appl. No. 13/394,233.
Feb. 25, 2014 Office Action issued in U.S. Appl. No. 13/394,233.
Sep. 30, 2013 Office Action issued in U.S. Appl. No. 13/394,233.
Apr. 22, 2013 Office Action issued in U.S. Appl. No. 13/394,233.
U.S. Appl. No. 13/394,233, filed Mar. 5, 2012 in the name of Hartert et al.

*Primary Examiner* — Vincent Tatesure
(74) *Attorney, Agent, or Firm* — Oliff PLC

(57) ABSTRACT

A method of manufacturing a penetration-resistant article that includes a textile fabric made from aramid fibers finished with finish solids. The finish solids include a carbonic acid polyester. The penetration-resistant article can be a fragment protection mat, a bullet-proof vest, a flak jacket, a stab-resistant vest, or a combination thereof.

12 Claims, No Drawings

METHOD OF MANUFACTURING A PENETRATION-RESISTANT ARTICLE THAT INCLUDES A TEXTILE FABRIC MADE FROM ARAMID FIBERS

CROSS REFERENCE TO RELATED APPLICATIONS

This is a Continuation of application Ser. No. 13/394,233 filed Mar. 5, 2012, which in turn is a national stage of PCT/EP2010/062522 filed Aug. 27, 2010, which claims the benefit of EP 09169383.8 filed Sep. 3, 2009. The disclosure of the prior applications is hereby incorporated by reference herein in its entirety.

BACKGROUND

Textile fabrics made from aramid fibers and the use thereof for the production of e.g. antiballistically effective textile fabrics are known. These fabrics commonly contain aramid fibers which were provided during the production thereof with a finish that comprises a polyglycol ester of oleic acid. A finish of this type is available under the trade name Leomin OR from Clariant, Germany. U.S. Pat. No. 4,652,488 describes the finishing of aramid fibers with Leomin OR.

When textile fabrics made from aramid fibers are processed for the production of an antiballistic article, which must, even in the wet state, include the antiballistic effect required of said article, then it is necessary to finish the textile fabric made from aramid fibers with water repellent. However, if one provides a textile fabric which is made from aramid fibers which are finished with a polyglycol ester of oleic acid with a water-repellent finish, then the textile fabric in the wet state has only the insufficient, low $v_{50}$ values of a textile fabric comprising aramid fibers which does not have a water-repellent finish. Therefore, it has been necessary up until now, prior to the application of the water-repellent finish on the textile fabric made from aramid fibers, to remove the finish comprising a polyglycol ester of oleic acid up to a residual content of ≤0.1 wt. % and then to mask the finish still remaining. The method required for this consists of the following steps:

1) Insertion of the textile fabric, in general a woven delivered in a roll form, into a washing machine (jigger);
2) Filling the jigger with fresh water;
3) Heating the fresh water to 80° C.;
4) Adding a surfactant suitable for washing off the finish;
5) Pre-washing in 2 passes, wherein each pass consists of
   $5_1$) Unrolling the woven from the roll,
   $5_2$) Feeding the woven through the surfactant/water mixture,
   $5_3$) Winding the woven up on an additional roll,
   $5_4$) Unrolling the woven from the additional roll,
   $5_5$) Feeding the woven through the surfactant/water mixture,
   $5_6$) Winding the woven up on the roll;
6) Draining the wash water from the jigger;
7) Filling the jigger with fresh water;
8) Heating the fresh water to 80° C.;
9) Adding a surfactant suitable for washing off the finish;
10) Rewashing in 10 passes, wherein each pass consists of the above mentioned steps $5_1$ to $5_6$;
11) Draining the wash water from the jigger;
12) Filling the jigger with fresh water;
13) Heating the fresh water to 80° C.;

14) Rinsing in 3 passes, wherein each pass consists of the steps corresponding to the above mentioned steps $5_1$ to $5_6$;
15) Draining the rinse water;
16) Filling the jigger with fresh water;
17) Heating the fresh water to 80° C.;
18) Adding a means for masking the finish remaining on the woven;
19) 10 masking passes, wherein each pass consists of the steps corresponding to the above mentioned steps $5_1$ to $5_6$;
20) Draining the water containing the masking means from the jigger;
21) Filling the jigger with fresh water;
22) Heating the fresh water to 80° C.;
23) Rinsing in 4 passes, wherein each pass consists of the steps corresponding to the above mentioned steps $5_1$ to $5_6$;
24) Removal of the roll with the woven from the jigger;
25) Passing of the woven through a drying oven at 170° C. with a residence time of the woven in the oven of approximately 60 seconds;

As mentioned above, to achieve the required $v_{50}$ values up until now, it was not until after undergoing the aforementioned washing and masking process that one could begin to finish the textile fabric made from aramid fibers with water repellent, i.e.

feeding the fabric through a bath of water and a water-repellent means,
squeezing out the fabric,
drying the fabric, and
heat treating the fabric.

The above mentioned washing and masking process is not only very costly with regard to the time, energy, and amount of water required, but also additionally requires a considerable effort in quality control. If the quality control determines after step 15) that the residual amount of the finish is >0.1 wt. %, then at least some of steps 1) to 15) must be repeated often enough to achieve the allowed residual amount of finish of ≤0.1 wt. %.

SUMMARY

Consequently, there is a need either to make the previously described method—the washing and masking process for preparing a suitable fabric made from aramid fibers for the application of a water-repellent means—completely superfluous or at least to significantly reduce the complexity of the method.

Therefore, it is the object of embodiments of the present invention either to make the previously described method—the washing and masking process for preparing a suitable fabric made from aramid fibers for the application of a water-repellent means—completely superfluous or at least to significantly reduce the complexity of the method.

In embodiments, this object is achieved by a textile fabric made from aramid fibers finished with a finishing agent, wherein the finishing agent comprises a carbonic acid polyester.

DETAILED DESCRIPTION OF EMBODIMENTS

Surprisingly, the inventive textile fabric can be finished directly with water repellent, i.e. while omitting the previously described 25-step washing and masking process, and nevertheless shows not only in the dry state but also in the wet state similarly as good $v_{50}$ values during ballistic and fragment bombardment as the textile fabric described at the beginning having aramid fibers with a finish comprising a polyglycol ester of oleic acid, which fabric still has to undergo the previously described 25 washing and masking steps before being finished with the water-repellent finish.

During fragment bombardment, the inventive textile fabric—which is in fact washed with the steps 1) to 15) as in the method described at the beginning, but wherein in step 10) only 6 passes are implemented and in step 14) the woven is only sprayed with water and not rinsed, and wherein the masking steps 16) to 24) are omitted—shows a $v_{50}$ value that is even higher than the $v_{50}$ value of a textile fabric with aramid fibers with a finish comprising a polyglycol ester of oleic acid, which still has to undergo all of the previously described 25 washing and masking steps prior to being finished with water repellent.

Thus, a person skilled in the art, to whom the inventive textile fabric is made available, can produce therefrom,

- either by completely omitting the washing and masking process that was necessary up until now, a textile fabric finished with a water repellent, which fabric has similarly as good $v_{50}$ values as the textile fabric described at the beginning having aramid fibers with a finish comprising a polyglycol ester of oleic acid, which fabric, however, must undergo the previously described 25 washing and masking steps prior to being finished with the water-repellent finish,
- or by partially omitting the washing process and completely omitting the masking process that were necessary up until now, a textile fabric finished with water repellent, which fabric has even higher $v_{50}$ values than the textile fabric described at the beginning having aramid fibers with a finish comprising a polyglycol ester of oleic acid, which fabric, however, must undergo the previously described 25 washing and masking steps prior to being finished with water repellent.

Within the context of the present invention, "textile fabric made from aramid fibers" means that the inventive textile fabric consists of at least 50 wt. %, preferably at least 65 wt. %, more preferably at least 80 wt. %, and particularly preferably at least 95 wt. % aramid fibers.

In an especially particularly preferred embodiment, the inventive textile fabric consists completely of aramid fibers which have been finished with a finishing agent, wherein the finishing agent comprises a carbonic acid polyester. Within the context of the present invention, the expression "carbonic acid polyester" means a polymer that is produced by polycondensation of a carbonic acid ester or carbonic acid dichloride with one or more diols, wherein one chain end or both chain ends of the carbonic acid polyester can comprise a hydroxyl group, or wherein one chain end or both chain ends of the carbonic acid polyester can comprise an alkyl radical of a monovalent alcohol. For example, the carbonic acid ester used for the polycondensation is a dialkyl carbonate. The diol used for the polycondensation can be an aliphatic diol or a polyalkylene glycol.

In a preferred embodiment of the inventive textile fabric, the carbonic acid polyester has the structural formula (I)

$$R_1-O-(CH_2CH_2-O-)_n-[-\underset{\underset{O}{\|}}{C}-(O-\underset{\underset{R_2}{|}}{CH}-CH_2)_m-O-]_z-R_3 \quad (I)$$

wherein $R_1$ is a linear or branched, saturated or monounsaturated alkyl radical having 6 to 22 carbon atoms, $R_2$ is hydrogen or $CH_3$, $R_3$ is hydrogen or the group $$-\underset{\underset{O}{\|}}{C}-(O-CH_2-CH_2)_n-O-R_1,$$

n is a whole number from 0 to 10, m is a whole number from 5 to 16 and z is a whole number from 1 to 3.

The carbonic acid polyester of structural formula (I), its preferred embodiments and its production methods are described in U.S. Pat. No. 5,569,408.

The finishing agent which is used to finish the aramid fibers which the inventive textile fabric comprises can consist 100% of a carbonic acid polyester, which preferably is a carbonic acid polyester of the structural formula (I).

However, it is also possible to apply the carbonic acid polyester, preferably the carbonic acid polyester of the structural formula (I), as an aqueous solution or as a solution or an emulsion in an organic solvent, such as in ethanol.

In a preferred embodiment of the inventive textile fabric, the finishing agent comprises a carbonic acid polyester of the formula (I), an alkyl polyglycol ether, a potassium alkyl phosphate, and an ethoxylated and/or propoxylated fatty alcohol, wherein the listed materials are formulated in water. A finishing agent of this type is obtainable from Bozetto (Italy) under the brand name Estesol NC 91. In a further preferred embodiment of the inventive textile fabric, the finishing agent comprises a carbonic acid polyester of the formula (I), an alkyl polyglycol ether, a potassium alkyl phosphate, an ethoxylated alcohol, and a polyglycol ester, wherein the listed materials are formulated in water. A finishing agent of this type is likewise obtainable from Bozetto (Italy) under the brand name Estesol CB 95.

In a further preferred embodiment of the inventive textile fabric, the aramid fibers finished with the finishing agent have, in relation to the weight of the fibers, 0.1 to 1.5 wt. %, particularly preferably 0.2 to 1.0 wt. % of finishing agent solids, wherein the wt. % of finishing agent solids means the solids representing the sum of the solids of the carbonic acid polyester, preferably the carbonic acid polyester of the structural formula (I), and, if applicable, the solids of the alkyl polyglycol ether, the potassium alkyl phosphate, the ethoxylated and/or propoxylated fatty alcohol, the ethoxylated alcohol, and the polyglycol ester.

To apply the finishing agent comprising the carbonic acid polyester, preferably the carbonic acid polyester of the structural formula (I), to the aramid fibers, every method is suitable by means of which the desired amount of finishing agent solids can be applied to the aramid fibers.

For example, the finishing agent comprising the carbonic acid polyester, preferably the carbonic acid polyester of the structural formula (I), can be applied during the production process of the aramid fibers, using a nozzle or with an applicator or with a kiss roll, after the washing and prior to the drying, after which the aramid fibers are dried and wound up. The application with a kiss roll means that a rotating roll is partially immersed in a bath, in which the finishing agent comprising the carbonic acid polyester is present, e.g. as an aqueous solution. A film made of the finishing agent comprising the carbonic acid polyester forms on the part of the roll protruding from the bath. The aramid fibers are brought into contact with the film and thereby finished.

Further, the finishing agent comprising the carbonic acid polyester, preferably the carbonic acid polyester of the structural formula (I), can also be implemented in a process downstream from the aramid fiber production. For this purpose, the fibers can be e.g. unwound from the roll and brought into contact with the finishing agent, wherein the finishing agent is free of water and/or organic solvents, and is present as an oil or as a melt.

It is also possible to implement the application in two or more steps that take place in series, wherein e.g. a first step occurs during the production process of the aramid fibers after the washing and prior to the drying, and a second step occurs in a process downstream of the aramid fiber production.

The inventive textile fabric can be basically any type of fabric that can be produced from aramid fibers. Preferably, the inventive textile fabric is a woven, a knitted fabric, or a uniaxial or multiaxial composite.

If the inventive textile fabric is a woven, the term woven comprises all types of weave, such as plain weave, satin weave, panama weave, twill weave, and the like. Preferably, the woven has a plain weave.

In a further preferred embodiment of the inventive textile fabric, the fabric is a double layer of a woven, wherein said double layer comprises a first woven layer which comprises a first thread group having 3.5 to 20 threads/cm with a linear density of at least 210 dtex and makes up at least 65% of the weight of said woven layer, and a second thread group having 0.5 to 16 threads/cm with a linear density of at least 50 dtex, wherein the second thread group runs transverse to the first thread group and the ratio of the number of threads/cm of the first thread group to the number of threads/cm of the second thread group is >1, and a second woven layer which comprises a first thread group having 0.5 to 16 threads/cm and a linear density of at least 50 dtex and a second thread group having 3.5 to 20 threads/cm and a linear density of at least 210 dtex and makes up at least 65% of the weight of said woven layer, wherein the second thread group runs transverse to the first thread group and the ratio of the number of threads/cm of the second thread group to the number of threads of the first thread group is >1, and wherein the first and second thread groups of the first layer run parallel to the first and second thread groups, respectively, of the second layer and the first thread group of the first layer and the first thread group of the second layer are warp threads and the second thread group of the first layer and the second thread group of the second layer are weft threads. A textile fabric of this type is described in WO 02/075238. A double layer is particularly preferred wherein

- the first thread group of the first woven layer and the second thread group of the second woven layer comprise aramid fibers which are finished with a finishing agent comprising a carbonic acid polyester, preferably a carbonic acid polyester of the formula (I), and
- the second thread group of the first woven layer and the first thread group of the second woven layer do not comprise aramid fibers, but are instead e.g. polyester fibers.

In a further particularly preferred embodiment of the inventive textile fabric, in which the fabric is a double layer of a woven, the threads of the two woven layers of the woven double layer are connected to each other e.g. by sewing or preferably by means of an adhesive material. The adhesive material can be a glue. The adhesive material can also be an adhesive layer which is provided between the two woven layers of the woven double layer. Thermoplastic, elastomeric or thermosetting materials can be used as the adhesive materials. A material can also be used for at least one part of the second thread group of the first layer and the first thread group of the second layer, which material melts under pressure and/or heating, by which means the threads of the first thread group and the second thread group are connected to the threads of the second thread group and the first thread group, respectively, and optionally also the two woven layers are also connected to each other. Polyolefins such as polyethylene and polypropylene, polyamides, polyesters, or mixtures of these materials can be used as the adhesive materials. Elastomeric materials that can be used as the adhesive materials include Kraton®, rubber, silicone, and the like. Thermosetting materials that can be used as the adhesive materials include epoxy resins, polyester resins, phenolic resins, vinyl ester resins, and the like.

In a further particularly preferred embodiment of the inventive textile fabric, in which the fabric is a double layer of a woven, at least one of the outer surfaces of the double layer is provided with a protective coating. The protective coating can comprises a thermoplastic, a thermosetting, or an elastomeric material or a mixture of said materials. The protective coating is applied in order to protect the woven from damage due to excessive rubbing and to improve the ballistic characteristics still further.

In the embodiment in which the inventive textile fabric is a double layer of a woven, the two layers of the double layer do not lie crosswise to each other and are optionally connected to each other. The term woven comprises all types of weave, such as plain weave, satin weave, panama weave, twill weave, and the like. Preferably, the wovens have a plain weave.

The inventive textile fabric comprises aramid fibers. Within the context of the present invention, the expression "aramid fibers" preferably means filament yarns that are produced from aramids, i.e. from aromatic polyamides, wherein at least 85% of the amide linkages (—CO—NH—) are attached directly to two aromatic rings.

For the present invention, particularly preferred aromatic polyamides are p-aramids, in particular polyparaphenylene terephthalamide, a homopolymer resulting from the mole-for-mole polymerization of paraphenylene diamine and terephthaloyl dichloride. Therefore, in a preferred embodiment, the aramid fibers which the inventive textile fabric comprises are p-aramid fibers, in particular polyparaphenylene terephthalamide fibers, and particularly preferred polyparaphenylene terephthalamide filament yarns, which are available under the trade name Twaron from Teijin Aramid GmbH (Germany).

Further, for the present invention, aromatic copolymers are suitable in which paraphenylene diamine and/or terephthaloyl dichloride are partially or completely substituted by other aromatic diamines and/or dicarboxylic acid chlorides.

As previously described, the inventive textile fabric enables a drastic simplification for providing a textile fabric made from aramid fibers and finished with water repellent. This advantage is accordingly noticeable when the inventive textile fabric is used in the production of a penetration-resistant article. Therefore, the use of the inventive textile fabric in the production of a penetration-resistant article is likewise part of the present invention.

For the inventive use in the production of the inventive penetration-resistant article, at least one inventive textile fabric is used. Preferably, a plurality of inventive textile fabrics are used, wherein a person skilled in the art who understands the invention can determine the number of inventive textile fabrics to be used corresponding to the intended penetration-resistant protective effect.

In a preferred embodiment of the inventive use, the inventive textile fabric is preferably used as a woven, wherein at least one woven is used. If a plurality of wovens are used, then the wovens are stacked on top of each other into a package. The individual wovens in the package can lie unconnected on top of each other or preferably be connected to each other by sewing or through another suitable connection technology, such as by partial adhesion.

In a further preferred embodiment of the inventive use, the inventive textile fabric is preferably used as a woven double layer, wherein at least one woven double layer is used. If a plurality of woven double layers are used, then the woven double layers are stacked on top of each other into a package. However, the individual woven double layers can be connected to each other by sewing or with an adhesive layer, wherein the adhesive layer preferably has a thickness between 4 and 36 μm and particularly preferably a thickness between 8 and 20 μm.

In a preferred embodiment of the inventive use, in which at least two inventive textile fabrics are stacked on top of each other into a package to produce a penetration-resistant article, the package can comprise a sequence of inventive wovens and woven double layers. In said sequence, the inventive wovens (G) and woven double layers (D) can alternate, i.e. in the sequence $(G/D)_n$ or preferably in blocks, i.e. in the sequence $(G_g/D_d)_m$, for example. In this case, n indicates the number of (G/D) pairs in the package, m the number of $(G_g/D_d)$ pairs in the package, g the number of wovens in the woven block G, and d the number of woven double layers in the woven double layer block D. A person skilled in the art can determine the numeric values for n, m, g, and d depending on the intended penetration-resistant protective effect.

In a preferred embodiment of the inventive use, the penetration-resistant, soft ballistic article is a fragment protection mat, a bullet-proof vest, a flak jacket, a stab-resistant vest, or a combination of at least two of the indicated articles.

EXAMPLES

Comparison Example a) Production of a Conventionally Finished Aramid Yarn

A polyparaphenylene terephthalamide filament yarn (Twaron, type 2040, 930 dtex f1000 t0) is finished in the production process thereof, after washing and prior to drying, with Leomin OR (Clariant, Germany). The dried fiber contains 0.6 to 0.8 wt. % Leomin OR solids.

b) Production of a Woven

The yarn resulting from a) is processed to a woven with an L 1/1 weave having 10.5 threads/cm in warp and weft and with a mass per unit area of 200 g/m$^2$.

c) Preparation of the Woven for Finishing with a Water-Repellent Means

In the subsequently described steps, the woven resulting from b) is pre-washed (see steps 1) to 6)), re-washed (see steps 7) to 11)), rinsed (see steps 12) to 15)), and masked and dried (see steps 16) to 25)).

1) Insertion of the woven, delivered in a roll form, into a jigger;
2) Filling the jigger with fresh water;
3) Heating the fresh water to 80° C.;
4) Adding the surfactant Kieralon OLB conc. (BASF) at a concentration of 1 g/l in relation to the fresh water;
5) Pre-washing in 2 passes, wherein each pass consists of
   $5_1$) Unrolling the woven from the roll,
   $5_2$) Feeding the woven through the surfactant/water mixture,
   $5_3$) Winding the woven up on an additional roll,
   $5_4$) Unrolling the woven from the additional roll,
   $5_5$) Feeding the woven through the surfactant/water mixture,
   $5_6$) Winding the woven up on the roll;
6) Draining the wash water from the jigger;
7) Filling the jigger with fresh water;
8) Heating the fresh water to 80° C.;
9) Adding the surfactant Kieralon OLB conc. (BASF) at a concentration of 1 g/l in relation to the fresh water;
10) Rewashing in 10 passes, wherein each pass consists of the above mentioned steps $5_1$ to $5_6$;
11) Draining the wash water from the jigger;
12) Filling the jigger with fresh water;
13) Heating the fresh water to 80° C.;
14) Rinsing in 3 passes, wherein each pass consists of the steps corresponding to the above mentioned steps $5_1$ to $5_6$;
15) Draining the rinse water;
16) Filling the jigger with fresh water;
17) Heating the fresh water to 80° C.;
18) Adding the masking means Erional RF (Huntsman, Germany) at a concentration of 3 g/l in relation to the fresh water;
19) 10 masking passes, wherein each pass consists of the steps corresponding to the above mentioned steps $5_1$ to $5_6$;
20) Draining the water containing the masking means from the jigger;
21) Filling the jigger with fresh water;
22) Heating the fresh water to 80° C.;
23) Rinsing in 4 passes, wherein each pass consists of the steps corresponding to the above mentioned steps $5_1$ to $5_6$;
24) Removal of the roll with the woven from the jigger;
25) Passing of the fabric through a drying oven at 170° C. with a residence time of the woven in the oven of approximately 60 seconds;

d) Finishing the Woven with a Water-Repellent Means;

The woven resulting after step 25) of c) is fed through a bath tempered to room temperature, which bath consists of water and, in relation to the water, 60 g/l Oleophobol SL, 30 g/l Oleophobal SM, and 10 g/l Phobol XAN (all from Huntsman, Germany). The woven is subsequently squeezed, dried at 120° C., and heat treated for 50 seconds at a temperature of 190° C.

E) Antiballistic Characteristics 22 layers of the woven resulting from d) are stacked into a package. The package is bombarded using bullets of the ammunition type 9 mm DM 41, and the $v_{50}$ value is determined. The $v_{50}$ value of the package in the dry state is 470±7 m/s (see table).

14 further layers of the woven resulting from d) are stacked into a package. The package is bombarded with fragments of the fragmentation type 1.1 FSP, and the $v_{50}$ value is determined. The $v_{50}$ value of the package is 484±6 in the dry state and 466±8 m/s in the wet state (see table).

Example 1 a) Production of an Inventively Finished Aramid Yarn

A polyparaphenylene terephthalamide filament yarn (Twaron, type 2040, 930 dtex f1000 t0) is finished in the production process thereof, after washing and prior to drying, with Estesol NC 91 from Bozetto (Italy). The dried fiber contains 0.26 wt. % Estesol NC 91 solids.

b) Production of a Woven

The yarn resulting from a) is processed to a woven with an L 1/1 weave having 10.5 threads/cm in warp and weft and with a mass per unit area of 200 g/m$^2$.

d) Finishing the Woven with a Water-Repellent Means

The woven resulting from b) is fed through a bath tempered to room temperature, which bath consists of water and, in relation to the water, 60 g/l Oleophobol SL, 30 g/l Oleophobal SM, and 10 g/l Phobol XAN (all from Huntsman, Germany). The woven is subsequently squeezed, dried at 120° C., and heat treated for 50 seconds at a temperature of 190° C.

e) Antiballistic Characteristics 22 layers of the woven resulting from d) are stacked into a package. The package is bombarded using bullets of the ammunition type 9 mm DM 41, and the $v_{50}$ value is determined. The $v_{50}$ value of the package in the dry state is 475±8 m/s (see table).

14 further layers of the woven resulting from d) are stacked into a package. The package is bombarded with fragments of the fragmentation type 1.1 FSP, and the $v_{50}$ value is determined. The $v_{50}$ value of the package is 493±13 in the dry state and 472±14 m/s in the wet state (see table).

Example 2 a) Production of an Inventively Finished Aramid Yarn

A polyparaphenylene terephthalamide filament yarn (Twaron, type 2040, 930 dtex f1000 t0) is finished in the production process thereof, after washing and prior to drying, with Estesol NC 91 from Bozetto (Italy). The dried fiber contains 0.26 wt. % Estesol NC 91 solids.

b) Production of a Woven

The yarn resulting from a) is processed to a woven with an L 1/1 weave having 10.5 threads/cm in warp and weft and with a mass per unit area of 200 g/m$^2$.

c) Preparation of the Woven for Finishing with a Water-Repellent Means

The woven resulting from b) is, as in the Comparison example, pre-washed in steps 1) to 6), re-washed in steps 7) to 11), with the difference, however, that in step 10) only 6 passes are implemented instead of 10, by which means significantly less time, water, and energy are consumed than in the Comparison example. Subsequently, the woven, as in the Comparison example, undergoes steps 12)-15), with the difference, however, that in step 14) the woven is only sprayed with water instead of being rinsed, by which means the water consumption is further reduced in comparison with the Comparison example. Subsequently, the woven is not masked; instead, steps 16)-24) are omitted and the woven is dried as in step 25) of the Comparison example.

d) Finishing the Woven with a Water-Repellent Means

The woven resulting from c) is fed through a bath tempered to room temperature, which bath consists of water and, in relation to the water, 60 g/l Oleophobol SL, 30 g/l Oleophobol SM, and 10 g/l Phobol XAN (all from Huntsman, Germany). The woven is subsequently squeezed, dried at 120° C., and heat treated for 50 seconds at a temperature of 190° C.

e) Antiballistic Characteristics 22 layers of the woven resulting from d) are stacked into a package. The package is bombarded using bullets of the ammunition type 9 mm DM 41, and the $v_{50}$ value is determined. The $v_{50}$ value of the package in the dry state is 463±6 m/s (see table).

14 further layers of the woven resulting from d) are stacked into a package. The package is bombarded with fragments of the fragmentation type 1.1 FSP, and the $v_{50}$ value is determined. The $v_{50}$ value of the package is 495±12 in the dry state and 490±8 m/s in the wet state (see table).

TABLE

| | Comparison example | Example 1 | Example 2 |
|---|---|---|---|
| Ballistic bombardment (dry) | $v_{50}$ = 470 ± 7 m/s | $v_{50}$ = 475 ± 8 m/s | $v_{50}$ = 463 ± 6 m/s |
| Fragment bombardment (dry) | $v_{50}$ = 484 ± 6 m/s | $v_{50}$ = 493 ± 13 m/s | $v_{50}$ = 495 ± 12 m/s |
| Fragment bombardment (wet) | $v_{50}$ = 466 ± 8 m/s | $v_{50}$ = 472 ± 14 m/s | $v_{50}$ = 490 ± 8 m/s |

The comparison of Example 1 with the Comparison example in the table shows that by using the inventive textile fabric made from aramid fibers finished with a carbonic acid polyester, while omitting all 25 pretreatment steps which conventional textile fabrics having aramid fibers finished with a polyglycol ester of oleic acid must undergo, a textile fabric finished with water repellent can be produced, the $v_{50}$ value of which

- is similarly as good as the $v_{50}$ value of the conventional textile fabric under ballistic bombardment and
- in the dry and also in the wet state even tends to be higher than the $v_{50}$ value of the conventional textile fabric under fragment bombardment.

The comparison of Example 2 with the Comparison example in the table shows that by using the inventive textile fabric made from aramid fibers finished with a carbonic acid polyester, in spite of omitting 4 re-washing steps and in spite of the substitution of spray passes for rinse passes, and in spite of the complete omission of the necessary masking steps, which conventional textile fabrics having aramid fibers finished with a polyglycol ester of oleic acid must undergo, a textile fabric finished with water repellent can be produced, the $v_{50}$ value of which

- is similarly as good as the $v_{50}$ value of the conventional textile fabric under ballistic bombardment and
- tends to be higher in the dry state and is significantly higher in the wet state, than the $v_{50}$ value of the conventional textile fabric under fragment bombardment.

What is claimed is:

1. A method of manufacturing a penetration-resistant article that comprises a textile fabric made from at least 80 wt. % of aramid fibers, the method comprising:

a) finishing aramid fibers with finish solids comprising a carbonic acid polyester, wherein the carbonic acid polyester is produced by polycondensation of a carbonic acid ester or carbonic acid dichloride with one or more diols, and one chain end or both chain ends of the carbonic acid polyester comprises a hydroxyl group or an alkyl radical of a monovalent alcohol;

b) processing the finished aramid fibers into a textile fabric comprising the finished aramid fibers; and c) processing the textile fabric into a penetration-resistant article, wherein the finish solids substantially remain on the finished aramid fibers throughout steps b) and c).

2. The method according to claim 1, wherein a residual content of the finish solids remaining on the finished aramid fibers throughout steps b) and c) is at least 0.1 wt. %.

3. The method according to claim 1, wherein a residual content of the finish solids remaining on the finished aramid fibers throughout steps b) and c) is more than 0.1 wt. %.

4. The method according to claim 1, wherein the aramid fibers are p-aramid fibers.

5. The method according to claim 1, wherein in step a), the aramid fibers have been washed but not dried during production of the aramid fibers before the aramid fibers are finished with the finish solids.

6. The method according to claim 1, wherein the carbonic acid polyester has a structure represented by the following structural formula (I):

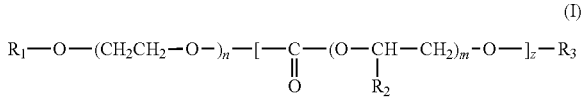

(I)

where in the structural formula (I), $R_1$ is a linear or branched, saturated or monounsaturated alkyl radical having 6 to 22 carbon atoms, $R_2$ is hydrogen or $CH_3$, $R_3$ is hydrogen or the group

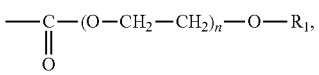

n is a whole number from 0 to 10, m is a whole number from 5 to 16, and z is a whole number from 1 to 3.

7. The method according to claim 1, wherein the finish solids further comprise:

an alkyl polyglycol ether;

potassium alkyl phosphate; and either (i) an ethoxylated and/or propoxylated fatty alcohol, or (ii) an ethoxylated alcohol and a polyglycol ester.

8. The method according to claim 1, wherein in step a), the aramid fibers are finished with 0.1 wt. % to 1.5 wt. % of the finish solids in relation to the weight of the aramid fibers.

9. The method according to claim 1, wherein in step a), the aramid fibers are finished with 0.2 wt. % to 1.0 wt. % of the finish solids in relation to the weight of the aramid fibers.

10. The method according to claim 1, further comprising: finishing the textile fabric with a water-repellent finish.

11. The method according to claim 1, wherein the finished aramid fibers are processed into the textile fabric either by weaving or knitting the finished aramid fibers to obtain a woven or knitted fabric, or by composing the finished aramid fibers uniaxially or multiaxially to obtain a uniaxial or multiaxial composite.

12. The method according to claim 1, wherein the textile fabric is a double layer of a woven, the double layer comprising:

(i) a first woven layer comprising a first thread group having 3.5 to 20 threads/cm with a linear density of at least 210 dtex and being at least 65% of a weight of the first woven layer, and a second thread group having 0.5 to 16 threads/cm with a linear density of at least 50 dtex, the second thread group running transverse to the first thread group and the ratio of the number of threads/cm of the first thread group to the number of threads/cm of the second thread group is >1, and (ii) a second woven layer comprising a first thread group having 0.5 to 16 threads/cm and a linear density of at least 50 dtex and a second thread group having 3.5 to 20 threads/cm and a linear density of at least 210 dtex and being at least 65% of a weight of the second woven layer, the second thread group running transverse to the first thread group and the ratio of the number of threads/cm of the second thread group to the number of threads of the first thread group is >1, wherein the first and second thread groups of the first woven layer run parallel to the first and second thread groups, respectively, of the second woven layer, and the first thread group of the first woven layer and the first thread group of the second woven layer are warp threads, and the second thread group of the first woven layer and the second thread group of the second woven layer are weft threads.

* * * * *